US006886520B2

(12) United States Patent
Nozaki et al.

(10) Patent No.: US 6,886,520 B2
(45) Date of Patent: May 3, 2005

(54) CYLINDER FOR INTERNAL COMBUSTION ENGINE AND METHOD OF TREATING INNER SURFACE OF THE CYLINDER

(75) Inventors: Katsumasa Nozaki, Kanagawa (JP); Shinji Tsuchiya, Kanagawa (JP); Motoi Hashiba, Kanagawa (JP); Hiroshi Fukuda, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/664,208

(22) Filed: Sep. 17, 2003

(65) Prior Publication Data

US 2004/0089260 A1 May 13, 2004

(30) Foreign Application Priority Data

Sep. 19, 2002 (JP) ..... 2002-273922

(51) Int. Cl.[7] ..... C25D 13/18; F16J 10/02; F02F 1/22

(52) U.S. Cl. ..... 123/193.2

(58) Field of Search ..... 123/193.2, 193.4; 205/103

(56) References Cited

U.S. PATENT DOCUMENTS 3,969,195 A * 7/1976 Dotzer et al. ..... 205/103
3,975,254 A * 8/1976 Elco et al. ..... 204/229.3
4,094,749 A * 6/1978 Stange et al. ..... 205/113
4,148,204 A * 4/1979 Dotzer et al. ..... 72/39
4,353,333 A * 10/1982 Iio ..... 123/73 R
4,478,689 A * 10/1984 Loch ..... 205/83
4,666,567 A * 5/1987 Loch ..... 205/83
5,000,127 A * 3/1991 Nishimura ..... 123/41.84
5,934,239 A * 8/1999 Koriyama ..... 123/193.2
5,948,235 A * 9/1999 Arai ..... 205/252
6,402,924 B1 * 6/2002 Martin et al. ..... 205/103
6,666,960 B2 * 12/2003 Arai et al. ..... 204/230.2

OTHER PUBLICATIONS

Patent Abstracts of Japan, Publication No. 06–146090 dated May 27, 1994, Application No. 04–294428 dated Nov. 2, 1992, Applicant–Nippon Steel Corp., Inventors: Suzuki Shinichi and Kanamura Tatsuya for Zinc–chromium Alloy Electroplating Method.

Patent Abstracts of Japan, Publication No. 11–307711 dated Nov. 5, 1999, Application No. 11–052362 dated Mar. 1, 1999, Applicant–Samsung Aerospace Ind Ltd., Inventors: Boku Seitetsu, Ri Keikan, Kin Chuho, Kyo Seinichi, Shin Toitsu and Cho Baijun for Lead Frame for Semiconductor Package, and Lead Frame Plating Method.

* cited by examiner

*Primary Examiner*—Marguerite McMahon
(74) *Attorney, Agent, or Firm*—Baker Botts LLP

(57) ABSTRACT

A cylinder for an internal combustion engine and a method for treating the inner surface of the cylinder, which enables the inner surface constituting a piston-sliding surface of the cylinder to have a high quality plated layer which is uniform in thickness and smooth in surface at low cost without necessitating grinding work such as honing work. The cylinder and the method of the present invention are characterized in that the inner surface of the cylinder is provided with a plated layer which is deposited thereon by a PR (Periodical Reverse) method employing a high-speed polarity reversal power source.

7 Claims, 4 Drawing Sheets

PRIOR ART

CYLINDER FOR INTERNAL COMBUSTION ENGINE AND METHOD OF TREATING INNER SURFACE OF THE CYLINDER

BACKGROUND OF THE INVENTION

1. Field of the Invention

The present invention relates to a cylinder for an internal combustion engine and to a method of treating the inner surface of the cylinder. In particular, the present invention relates to an internal combustion engine made of an aluminum alloy and having a plated inner surface constituting a piston-sliding surface, and to a method of treating the inner surface of the aluminum alloy cylinder.

2. Description of the Related Art

As a typical example of the conventional cylinder for a small air-cooled two-stroke gasoline engine to be employed in a portable power working machine, there is known a cylinder as shown in FIG. 4 (which also illustrates one embodiment of the present invention as explained hereinafter). The cylinder 1 shown in FIG. 4 is formed of an aluminum alloy and constituted by an integral body consisting of a main body 2 provided with a pair of columnar protruded portions 2*a* disposed diametrally opposite to each other, a head portion 3 having a squish dome-shaped combustion chamber 4 formed therein, and a large number of cooling fins projecting from all over the outer wall of the integral body. Further, the head portion 3 is provided therein with an internal thread 18 for mounting an ignition plug.

The main body 2 is provided, on the inner surface 9 thereof with which the piston of the engine is slidably contacted (or the surface of cylinder bore), with a suction port 5 and also with an exhaust port 6, both of which are designed to be closed or opened by the movement of the piston (indirected in phantom lines at 15). The suction port 5 and the exhaust port 6 are disposed to face each other in an off-set manner so that they disagree in level from one another. Furthermore, the main body 2 is also provided with a pair of columnar expanded portions 2*a*, in each of which a scavenging duct 7 accompanied by an inner wall 7*a* having a predetermined thickness (hereinafter referred to as inner wall-attached scavenging duct) is formed, these scavenging duct 7 being displaced in the circumferential direction of the cylinder bore 9 from the suction port 5 and the exhaust port 6 by an angle of 90 degrees. The downstream end portion (upper end portion) of each scavenging duct 7 is constituted by a scavenging port 8, thereby providing a pair of scavenging ports 8 which are disposed opposite to each other and designed to be opened and closed by the piston 15. The scavenging ports 8 are inclined somewhat upwardly in the direction opposite to that of the exhaust port 6 of the cylinder bore 9.

The cylinder disclosed in FIG. 4 is a so-called Schnürle binary fluid scavenging type cylinder, wherein a pair of scavenging ports 8 are symmetrically formed with respect to the longitudinal section taken along the middle of the exhaust port 6. Additionally, there is also known a so-called quaternary fluid scavenging type cylinder where another pair of scavenging ports are additionally provided therewith (two pairs of scavenging ports in total). As for the type of the scavenging duct, there are known a scavenging duct provided with an inner wall 7*a* as shown in FIG. 4, and a scavenging passageway having no inner wall 7*a* (the cylinder bore surface 9 side is opened). There is also known a half-wall, attached scavenging duct which is featured in that it is provided at a lower portion thereof with an opening extending in the longitudinal direction of the scavenging duct while leaving a half-wall having a predetermined thickness at an upper portion thereof so as to allow an air-fuel mixture introduced into the scavenging port from the crank chamber via the scavenging duct to be contacted with a skirt portion of the piston.

The cylinder 1, which is designed to be employed in a two-stroke internal combustion engine and made of an aluminum alloy as described above, is generally subjected to plating treatment (for forming a plated layer 10) subsequent to the cast molding thereof, by means of a high-pressure die casting method for instance, so as to enhance the abrasion resistance of the cylinder bore surface 9 with which the piston 15 is slidably contacted.

As for the plating treatment of the cylinder bore surface 9 of the cylinder 1, nickel (Ni)-based plating or chromium (Cr)-based plating using DC power as a power source have been chiefly employed up to date. However, the plating using DC power is accompanied by a problem in that, when the plating using DC power source is applied to the cylinder bore surface 9, a protuberance 10*a* is generated in the plated layer 10 at the fringe portion of the opening of a port as illustrated in FIG. 3, where the opening of a port portion (herein, the suction port 5 is shown as a representative example) such as the suction port 5, the exhaust port 6 and the scavenging ports 8 each penetrating through the cylinder bore surface 9 is shown. In addition to that, the plating using DC power is also accompanied by a problem in that whisker-like protrusions 10*b* called "carbon trumpet" are generated (FIG. 3), thereby making the thickness of the plated layer non-uniform and also roughening the surface of the plated layer. If such protuberance 10*a* is permitted to exist in the plated layer 10, resulting in non-uniformity and roughness in the surface of the plated layer, the sliding properties of the piston would be deteriorated, making the cylinder unsuitable for practical use.

Therefore, it has been conventionally practiced to form the plated layer 10 in such a manner that, by taking the finishing allowance into consideration, the plated layer 10 is initially formed relatively thick, and then, the resultant plated layer 10 is subjected to grinding work such as honing work of the cylinder bore surface 9 or chamfering work of each of the port portions, thus resulting in increase in manufacturing cost of the cylinder for an internal combustion engine.

SUMMARY OF THE INVENTION

It is an object of the present invention to overcome the aforementioned problems. In accordance therewith, the present invention provides a cylinder for an internal combustion engine having an inner surface constituting a piston-sliding surface, which surface has been subjected to a plating treatment to thereby form a high quality plated layer which is uniform in thickness and smooth in surface at low cost without necessitating grinding work such as honing work.

With a view to realizing the aforementioned object, the present invention provides a cylinder for an internal combustion engine made of an aluminum alloy and having an inner surface constituting a piston-sliding surface and having formed therein at least one suction port, at least one exhaust port, and at least one scavenging port which are designed to be opened and closed by the piston, the inner surface of the cylinder also having a plated layer such as an iron-based or nickel-based plated layer deposited thereon by a PR (Periodical Reverse) method employing a high-speed polarity reversal power source.

According to a preferable embodiment, the plated layer is deposited on the cylinder inner surface so as to be employed as a piston-sliding surface without being further subjected to grinding work such as honing work.

In this case, the thickness of plated layer is preferably confined to the range of 10 to 20 μm.

As another feature of the invention, a method of treating the inner surface of cylinder for an internal combustion engine according to the present invention comprises subjecting the inner surface constituting a piston-sliding surface of the cylinder to plating by a PR method employing a high-speed polarity reversal power source.

According to a preferable embodiment, an anode having a cylindrical configuration is introduced into the cylinder and, at the same time, a plating solution is permitted to flow from a plating solution tank to fill the cylinder with the plating solution through the anode and then to flow out of the cylinder to return to the plating solution tank, thereby permitting the plating solution to circulate between the cylinder and the plating solution tank.

In a more preferable embodiment, the duration of time for passing a positive electric current is 50 ms or less, and the duration of time for passing a reverse electric current is 5 ms or less.

Herein, the PR (Periodical Reverse) method employing a polarity reversal power source is generally known as a method for mainly obtaining glossy plating. In this case, positive electric current (positive power) and reverse electric current (reverse power) are periodically reversed, thereby repeating the generation and dissolution of plated layer. During the time the reverse electric current is being transmitted, protruded portions are preferentially dissolved by electrolytic polishing effects, and during the time the positive electric current is being transmitted, the depolarization effect of the concentration polarization of recessed portions is enhanced, thus promoting the smoothing of the plated layer. This PR method is generally employed in such a manner that the flowing time for the positive electric current is set to a period of 15 to 20 seconds, and the flowing time for the reverse electric current is set to a period of 3 to 4 seconds. If the flowing time for the reverse electric current is too short, the effect of smoothing the plated layer would be minimized. If the flowing time for the reverse electric current is too long, the velocity of plating would be decreased.

The high-speed polarity reversal power source to be employed in the inner surface treating method according to the present invention has been recently developed mainly as a power source for the copper plating of printed wiring board and is capable, through the control of pulse, of reversing the polarities between positive electric power and reverse electric power at minute intervals of 50 ms or less. Furthermore, this high-speed polarity reversal power source is capable of minimizing polarity reversal loss, and is expected to give improved plated surface-smoothing effects as compared with the case where the conventional polarity reversal power source is employed.

On the occasion of performing the plating by means of the PR method using the aforementioned high-speed polarity reversal power source, it is required to set the value of positive electric current, the duration of flowing positive electric current, the value of reverse electric current, and the duration of flowing reverse electric current to predetermined values, respectively.

In a preferable embodiment of the method of treating the inner circumferential surface of a cylinder bore according to the present invention, electrolysis (electroplating) is performed by fixing the ratio of integrated positive current/integrated reverse current to a prescribed value falling within the range of 1 to 100, wherein the ratio of integrated positive current/integrated reverse current is defined as a ratio of an integrated quantity of positive current to an integrated quantity of reverse current, where the integrated quantity of positive current is equal to "a value of positive electric current multiplied by the duration of flowing the positive electric current" and the integrated quantity of reverse current is equal to "a value of reverse electric current multiplied by the duration of flowing the reverse electric current".

More specifically, if the value of the positive electric current is set to 200 A, the duration of flowing the positive electric current is set to 40 ms, the value of the reverse electric current is set to 800 A, and the duration of flowing the reverse electric current is set to 4 ms, then the ratio of integrated positive current/integrated reverse current can be calculated as: $(200\times40)/(800\times4)=2.5$. Therefore, the electrolytic plating will be performed with the integrated positive current/integrated reverse current ratio being set to 2.5 for a predetermined period of time, 45 seconds for example.

When the electrolytic plating is performed by making use of the high-speed polarity reversal power source and by fixing the integrated positive current/integrated reverse current ratio to 2.5, the generation of the aforementioned whisker-like protrusions referred to as "carbon trumpet" can be suppressed, thereby making it possible to obtain a plated layer which is improved in uniformity of layer thickness and in smoothness as compared to a plated layer obtained from the ordinary plating using a DC power source according to the prior art. However, even with this improved plated layer, it may not necessarily be satisfactory for use as a piston-sliding surface, without grinding work (finishing work), such as honing work of the cylinder bore surface, even though the quantity of work may be considerably minimized as compared to that required in the prior art.

According to another preferable embodiment of the method of treating the inner circumferential surface of the cylinder bore according to the present invention, the electrolysis is performed while changing in a stepwise manner the aforementioned integrated positive current/integrated reverse current ratio and taking a predetermined period of time at each step.

More specifically, in a first step, the electrolysis is performed for 60 seconds for example, with the integrated positive current/integrated reverse current ratio being selected from the range of 1 to 100, for example selecting 5, thereby allowing a plated layer to deposit on the inner circumferential surface of the cylinder bore. Then, in a second step, the electrolysis is performed for 35 seconds for example, with the integrated positive current/integrated reverse current ratio being selected from the range of 0.01 to 0.9, for example selecting 0.2, thereby allowing the aforementioned plated layer (protruded portion thereof) to dissolve. By doing the electrolysis in this manner, the uniformity and smoothing of the plated layer can be further promoted as compared with the case where the aforementioned integrated positive current/integrated reverse current ratio is fixed to a constant value. However, since the plated layer is permitted to deposit on the surface of the anode during the second step, an additional electrolysis is performed as a third stage taking 60 seconds and selecting the integrated positive current/integrated reverse current ratio from the range of 1 to 100, for example selecting 2.5.

The plated layer which has been formed on the inner circumferential surface of cylinder bore in this manner is excellent in uniformity of thickness and in smoothness, and still more, the surface hardness of the plated layer is enhanced as compared with the case where the conventional DC power source is employed, thereby rendering the inner circumferential surface of cylinder bore sufficiently endurable for practical use as a piston-sliding surface without necessitating any additional work thereof. Therefore, it is no longer required to perform grinding work such as honing work of the cylinder bore surface after the plating treatment. Namely, only the brushing thereof would be sufficient.

DETAILED DESCRIPTION OF EXEMPLARY EMBODIMENTS THE INVENTION

The present invention will be further explained with reference to one embodiment of a cylinder for an internal combustion engine according to the present invention.

Figure 4:
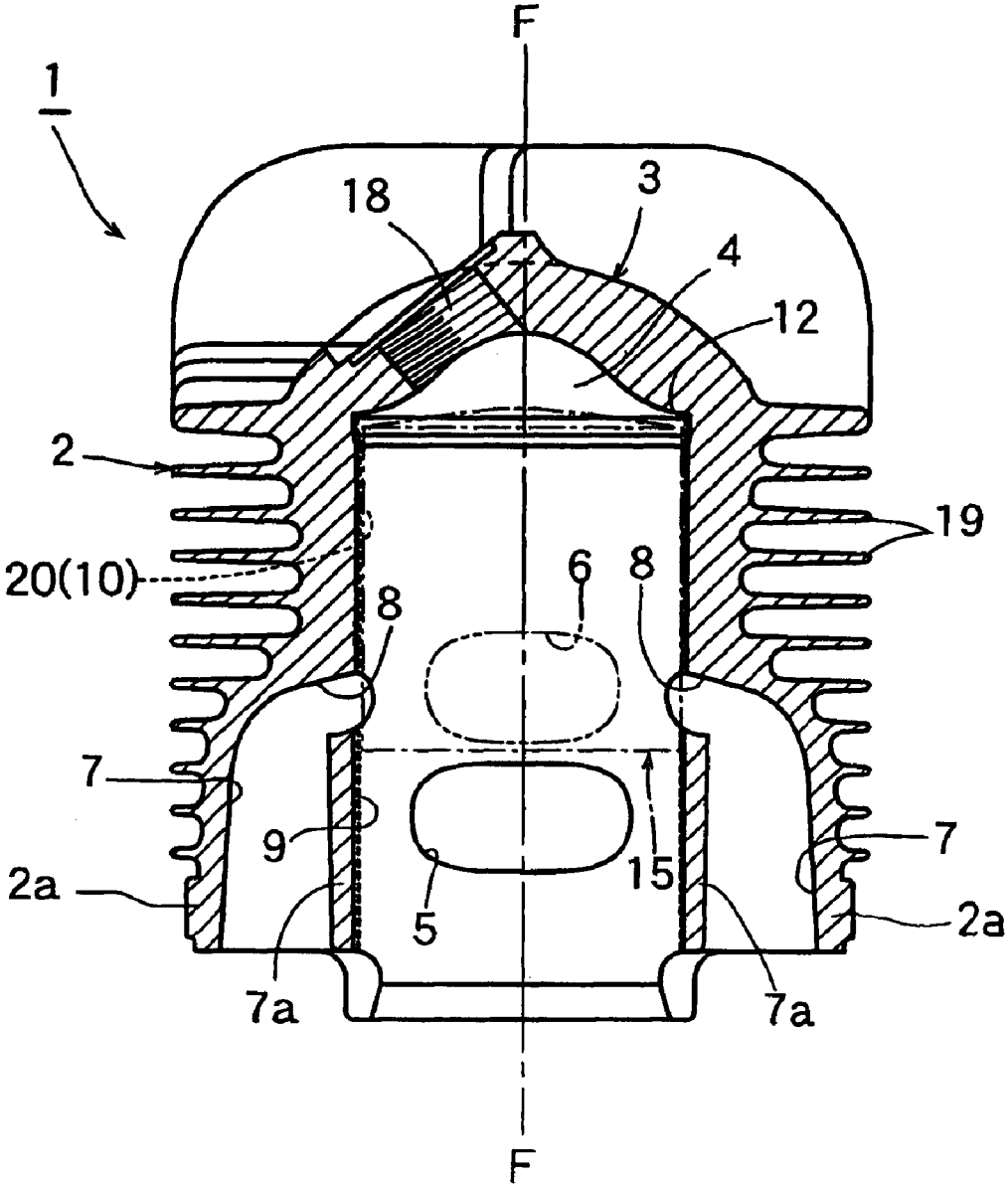
FIG. 4 is a longitudinal sectional view illustrating a cylinder for an internal combustion engine according to one embodiment of the present invention.

The cylinder for an internal combustion engine according to the present invention is made of an aluminum alloy and is designed to be employed in a small air-cooled two-stroke gasoline engine which can be employed in a portable working machine such as a brush cutter, a chain saw, etc. As shown in FIG. 4 illustrating a longitudinal sectional view of the entire structure thereof, the cylinder 1 is constituted by an integral body consisting of a main body 2 provided with a pair of columnar protruded portions 2*a* disposed diametrally opposite to each other, a head portion 3 having a squish dome-shaped combustion chamber 4 formed therein, and a large number of cooling fins projecting from all over the outer wall of the integral body. Further, the head portion 3 is provided therein with an internal thread 18 for mounting an ignition plug.

The main body 2 is provided, on the inner surface 9 thereof with which the piston of the engine is slidably contacted (or the surface of cylinder bore), with a suction port 5 and also with an exhaust port 6, both of which are designed to be closed or opened by the movement of the piston (indirected in phanton lines at 15), the suction port and the exhaust port being disposed to face each other in an off-set manner so that they disagree in level from one another. Furthermore, the main body 2 is also provided with a pair of columnar expanded portions 2*a*, in each of which a scavenging duct 7 accompanied with an inner wall 7*a* having a predetermined thickness (hereinafter referred to as inner wall-attached scavenging duct) is formed. The scavenging duct 7 are displaced away along the circumferential direction of the cylinder bore 9 from the suction port 5 and the exhaust port 6 by an angle of 90 degrees. The downstream end portion (upper end portion) of each scavenging duct 7 is constituted by a scavenging port 8, thereby providing a pair of scavenging ports 8 which are disposed opposite to each other and designed to be opened and closed by the piston 15, the scavenging ports 8 being inclined somewhat upward in the direction opposite to that of the exhaust port 6 of the cylinder bore 9.

Figure 1:
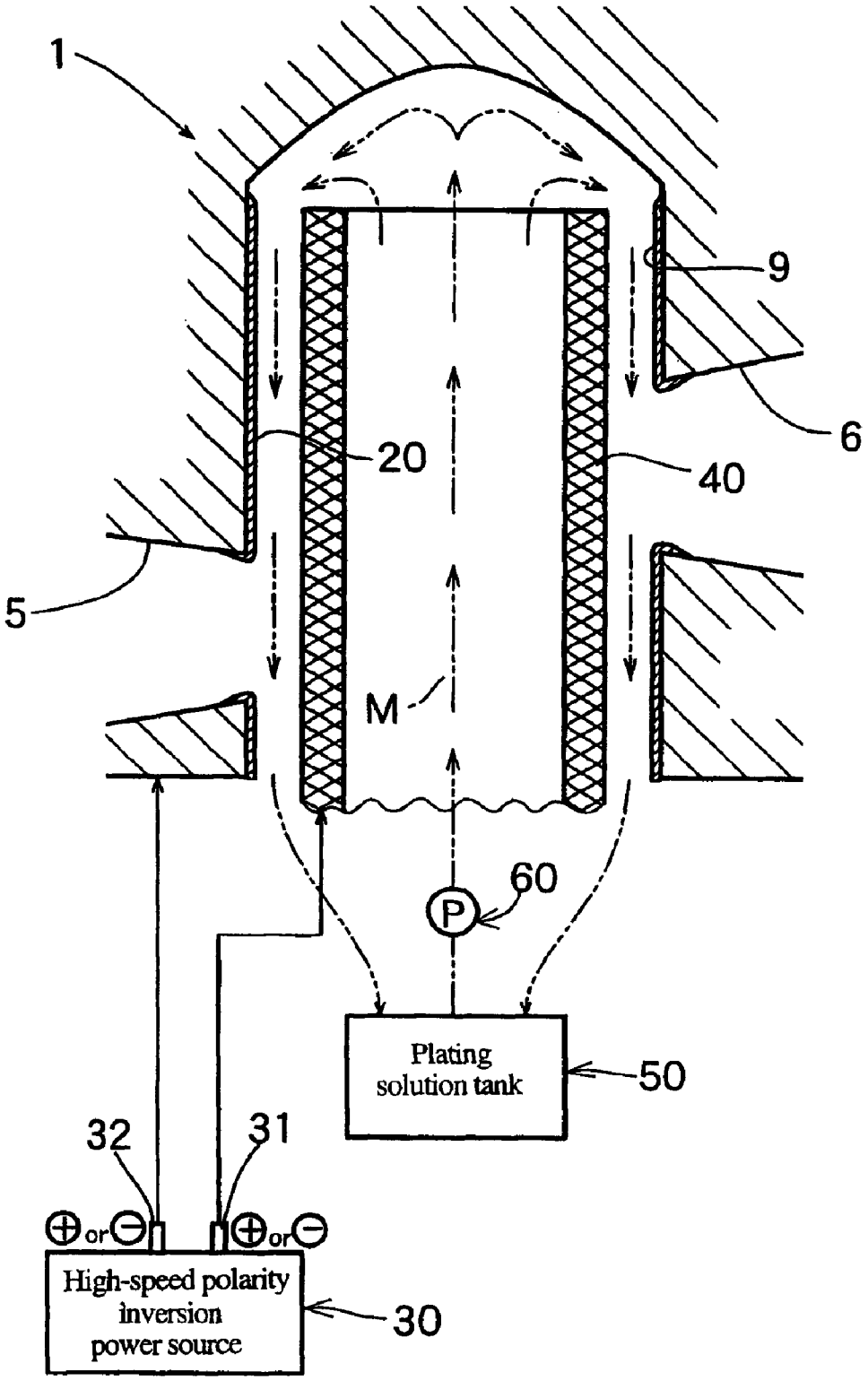
FIG. 1 is a longitudinal sectional view of the exhaust port portion of the cylinder for use in an internal combustion engine, schematically illustrating a state of plating treatment which is being performed by the method of treating the inner circumferential surface of the cylinder bore according to one embodiment of the present invention.

As schematically shown in FIG. 1 illustrating a longitudinal sectional view (taken along a line F—F of FIG. 4) of the exhaust port portion of the cylinder 1 for explaining a state of plating treatment of the cylinder 1, the inner surface 9 of the cylinder 1 with which the piston 15 is slidably contacted is subjected, after the die casting thereof by means of a high-pressure die casting method for example, to a nickel-based plating (forming a plated layer 20) for example by means of the PR (Periodical Reverse) method employing a high-speed polarity reversal power source 30 so as to enhance the abrasion resistance of the inner surface 9.

The high-speed polarity reversal power source 30 is well known and is capable, through the control of the current pulse, of reversing the polarities (positive electric power and reverse electric power) at minute intervals of 50 ms or less. In this case, one of the terminals ((+) electrode on the occasion of flowing positive current) 31 is electrically connected with an anode 40, while the other terminal ((−) electrode on the occasion of flowing positive current) 32 is electrically connected with the cylinder 1 formed of a base material. The anode 40 is formed of a platinum (Pt)-based material for instance and is configured into a cylindrical body having an outer diameter slightly larger than the diameter of the inner circumferential surface (cylinder bore) 9 of the cylinder. On the occasion of performing the plating, the anode 40 is co-axially inserted into the cylinder 1 and positioned in such a manner that the upper end portion thereof is made flush with the upper end of the inner circumferential surface 9.

In this embodiment, a plating solution M containing nickel ion is supplied from a plating solution tank 50 by means of a pump 60 so as to fill, through the aforementioned cylindrical anode 40, the interior of the cylinder 1 with the plating solution M. In this case, the plating solution M is fed in such a manner that the plating solution M is permitted to flow upward through the inside of the anode 40, then flow over the upper brim of the anode 40 and fall downward through an annular duct formed between the outside of the anode 40 and the inner circumferential surface 9 of the cylinder. The plating solution M overflowed in this manner is ultimately permitted to return to the plating solution tank 50, thus enabling the plating solution M to circulate between the interior of cylinder 1 and the plating solution tank 50. It is possible, in this manner, to accelerate the plating velocity as compared with the case where the plating is performed under the condition that the entire body of the cylinder 1 is kept immersed in a plating solution.

On the occasion of performing the plating by means of the PR method using the aforementioned high-speed polarity reversal power source 30 and under the conditions explained above, it is required to set the value of the positive electric current, the duration of flowing the positive electric current, the value of reverse electric current, and the duration of the flowing reverse electric current to predetermined values, respectively.

In a preferable embodiment of the method of treating the inner circumferential surface of cylinder bore according to the present invention, electrolysis (electroplating) is performed by fixing the ratio of integrated positive current/integrated reverse current to a prescribed value falling within the range of 1 to 100. The ratio of integrated positive current/integrated reverse current is defined as a ratio of an integrated quantity of positive current to an integrated quantity of reverse current, where the integrated quantity of positive current is equal to "a value of positive electric current multiplied by the duration of flowing of the positive electric current" and the integrated quantity of reverse current is equal to "a value of reverse electric current multiplied by the duration of flowing of the reverse electric current".

More specifically, if the value of the positive electric current is set to 200 A, the duration of flowing the positive electric current is set to 40 ms, the value of the reverse electric current is set to 800 A, and the duration of flowing the reverse electric current is set to 4 ms, the ratio of integrated positive current/integrated reverse current can be calculated as: (200×40)/(800×4)=2.5. Therefore, the electrolytic plating will be performed with the integrated positive current/integrated reverse current ratio being set to 2.5 for a predetermined period of time, 45 seconds for example.

When the electrolytic plating is performed in this manner by making use of the high-speed polarity reversal power source 30 and by fixing the integrated positive current/integrated reverse current ratio to 2.5, the generation of the aforementioned whisker-like protrusions 10*b*, referred to as "carbon trumpet" (see FIG. 3), can be suppressed, thereby making it possible to obtain a plated layer 10 which is improved in uniformity of layer thickness and in smoothness as compared with a plated layer to be obtained from the ordinary plating using a DC power source according to the prior art. However, even with this improved plated layer, it may not necessarily be satisfactory for use as a piston-sliding surface, because it may still require some grinding work (finishing work) such as honing work of the cylinder bore surface even though the quantity of work may be considerably minimized as compared with that required in the prior art.

In a second embodiment of the method of treating the inner circumferential surface of a cylinder bore according to the present invention, the electrolysis is performed by changing in a stepwise manner the aforementioned integrated positive current/integrated reverse current ratio and taking a predetermined period of time at each step.

More specifically, in a first step, the electrolysis is performed for a predetermined period of time, 60 seconds for example, with the value of the positive current being set to ½ of the reverse current, the duration of flowing the positive electric current being set to 10 times as high as that of the reverse electric current and the integrated positive current/integrated reverse current ratio being set to 5 for instance, thereby allowing a plated layer 20 to deposit on the inner circumferential surface 9 of the cylinder bore.

Then, in a second step, the electrolysis is performed for a predetermined period of time, 35 seconds for example, with the value of the positive current being set to 1/20 of the reverse current, the duration of the flowing positive electric current being set to 4 times as high as that of the reverse electric current and the integrated positive current/integrated reverse current ratio being set to 0.2 for instance, thereby allowing the aforementioned plated layer 20 (protruded portion thereof) to dissolve. By performing the electrolysis in this manner, the uniformity and smoothness of the plated layer 20 can be further promoted as compared with the case where the aforementioned integrated positive current/integrated reverse current ratio is fixed to a constant value.

However, since the plated layer is permitted to deposit on the surface of the anode 40 during the second step, a third stage is performed so as to remove this plated layer by taking a predetermined period of time, 60 seconds for example, with the value of the positive current being set to ¼ of the reverse current, the duration of flowing the positive electric current being set to 10 times as high as that of reverse electric current and the integrated positive current/integrated reverse current ratio being set to 2.5 for instance.

Figure 2:
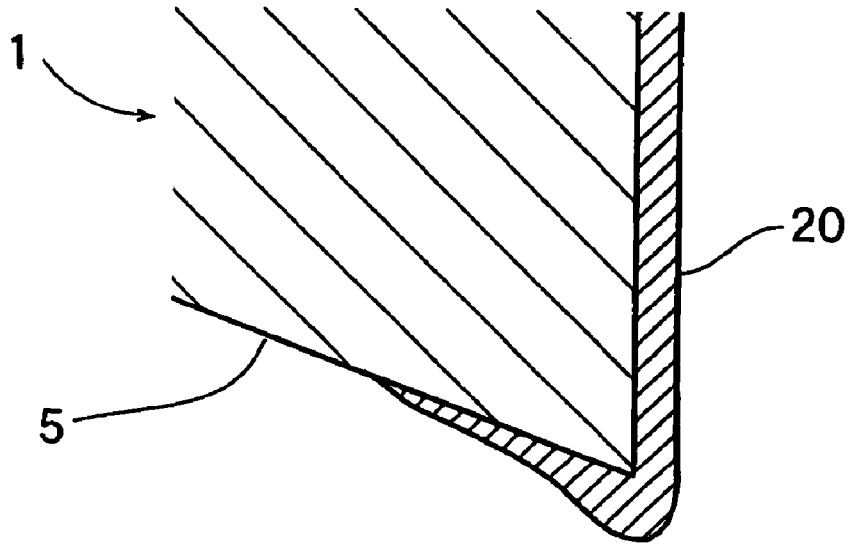
FIG. 2 is a longitudinal sectional view illustrating a deposited state of the plated layer at an opening portion of the suction port of the cylinder of an internal combustion engine according to one embodiment of the present invention.
Figure 2:
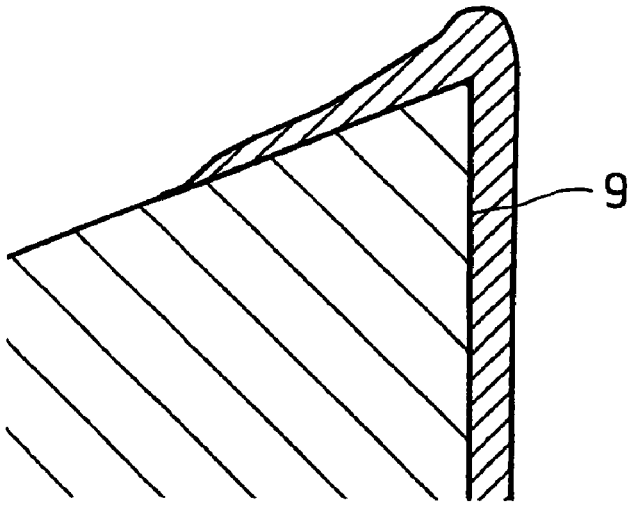
Figure 3:
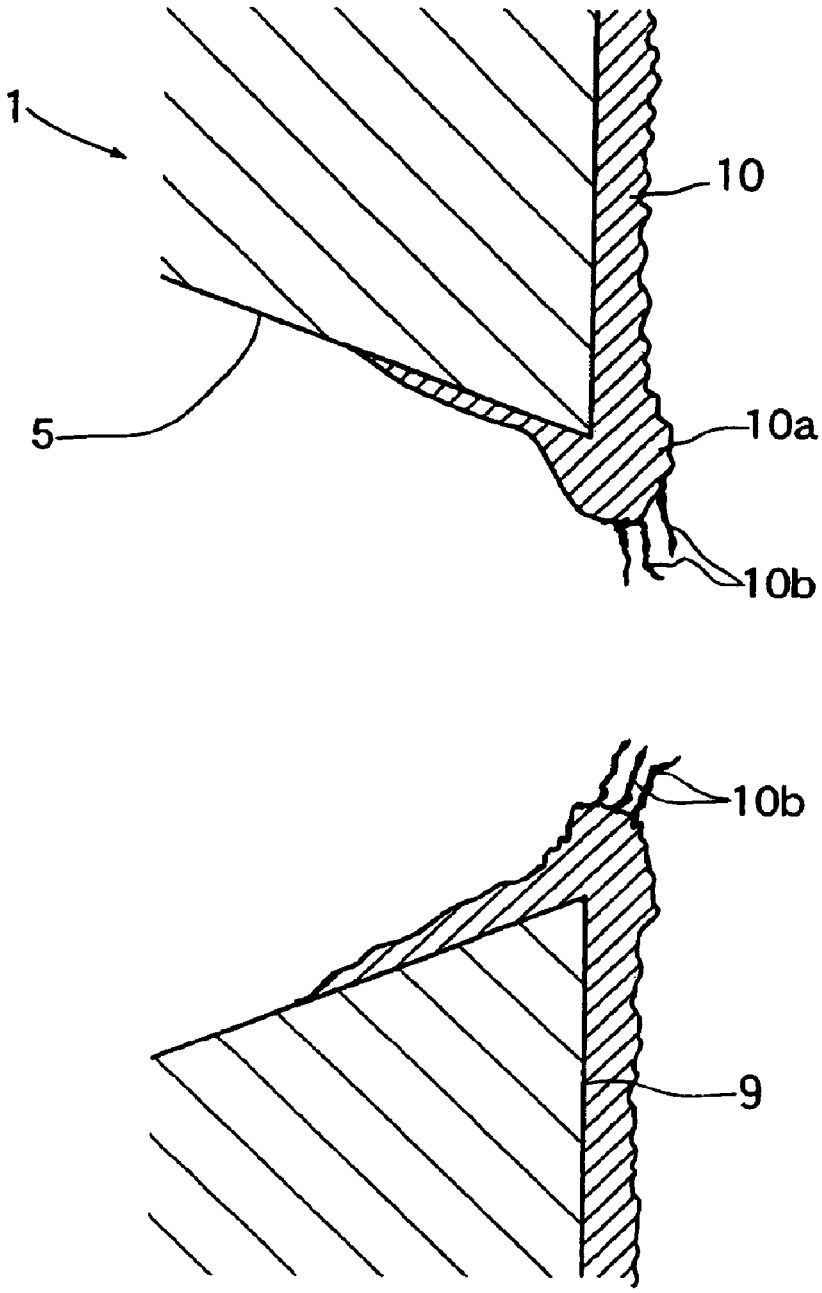
FIG. 3 is a longitudinal sectional view illustrating a deposited state of the plated layer formed according to the prior art at an opening portion of the suction port of the cylinder of an internal combustion engine representing one embodiment of the prior art.

When the electrolysis (plating) is performed while changing the integrated positive current/integrated reverse current ratio in a stepwise manner, i.e. in three steps as explained above, and taking a predetermined period of time at each step, the plated layer 20 to be deposited on the inner circumferential surface 9 of the cylinder bore would be controlled to have a uniform thickness of about 15 $\mu$m and a sufficiently flat surface as represented by the suction port 5 portion shown in FIG. 2 without the accompanying generation of prominent protuberance 10*a* or whisker-like protrusions 10*b* called "carbon trumpet," as seen in the conventional plated layer which is illustrated in FIG. 3. The thickness of the plated layer 20 would be determined by the aforementioned factors including the value of the positive electric current, the duration of flowing the positive electric current, the value of the reverse electric current, the duration of flowing the reverse electric current, the integrated quantity of the positive current, the integrated quantity of the reverse current, and the ratio of integrated positive current/integrated reverse current. When the hardness, sliding performance and tenacity which are demanded of the piston-sliding surface are taken into consideration, the thickness of the plated layer 20 should preferably be confined within the range of 10 to 20 $\mu$m.

Furthermore, since the surface hardness of the plated layer is enhanced as compared to the case where the conventional DC power source is employed, the inner circumferential surface of the cylinder bore would be made sufficiently endurable for practical use as a piston-sliding surface without necessitating any additional work thereof. Therefore, it is no longer required to perform grinding work such as honing work of the cylinder bore surface after the plating treatment. Only the brushing thereof would be sufficient.

While the foregoing embodiment of the present invention has been explained in detail for the purpose of illustration, it will be understood that the construction of the device can be varied without departing from the spirit and scope of the invention as claimed in the following claims.

As clearly seen from the foregoing explanations, according to the method of treating the inner surface of a cylinder for an internal combustion engine as proposed by the present invention, it is possible to improve the uniformity and surface flatness of the plated layer to be formed on the inner surface constituting a piston-sliding surface, thus obviating the grinding work such as honing work of the plated layer. Therefore, it is now possible to provide a cylinder for an internal combustion engine, having an inner surface which is subjected to a high quality plating treatment at low cost.

What is claimed is:

1. A cylinder for an internal combustion engine comprising:

an inner surface constituting a piston-sliding surface and having formed therein at least one suction port, at least one exhaust port and at least one scavenging port which are designed to be opened and closed by the piston: and the cylinder is made of an aluminum alloy and said inner piston-sliding surface has a plated layer deposited thereon by a PR (Periodical Reverse) method employing a high-speed polarity reversal power source, wherein said plated layer deposited on the inner piston-sliding surface is employed as a piston-sliding surface without being further subjected to grinding work.

2. The cylinder for an internal combustion engine according to claim 1, wherein said plated layer has a thickness ranging from 10 $\mu$m to 20 $\mu$m.

3. A method of treating an inner surface of a cylinder for an internal combustion engine, comprising the step of subjecting the inner surface constituting a piston-sliding surface of the cylinder to plating by means of a PR method employing a high-speed polarity reversal power source, wherein the step of subjecting the inner surface constituting a piston-sliding surface of the cylinder to plating by means of a PR method employing a high-speed polarity reversal power source comprises:

introducing an anode having a cylindrical configuration into the cylinder; and at the same time, permitting a plating solution to flow from a plating solution tank to fill said cylinder with the plating solution through said anode and then to flow out of said cylinder to return to said plating solution tank, thereby permitting the plating solution to circulate between said cylinder and said plating solution tank.

4. The method according to claim 3, wherein during said plating a duration of time for passing a positive electric current is 50 ms or less, and a duration of time for passing a reverse electric current is 5 ms or less.

5. The method according to claim 3, wherein electrolysis for said plating is performed for a predetermined period of time by fixing a ratio of integrated positive current/integrated reverse current to a prescribed value falling within a range of 1 to 100, wherein the ratio of integrated positive current/integrated reverse current is defined as a ratio of an integrated quantity of positive current to an integrated quantity of reverse current, where the integrated quantity of positive current is equal to "a value of positive electric current multiplied by the duration of flowing the positive electric current" and the integrated quantity of reverse current is equal to "a value of reverse electric current multiplied by the duration of flowing the reverse electric current".

6. The method according to claim 5, wherein said electrolysis is performed by changing in steps the integrated positive current/integrated reverse current ratio and taking a predetermined period of time at each step.

7. The method according to claim 6, wherein said electrolysis is performed in a manner that in a first step, said electrolysis is performed for a predetermined period of time with the integrated positive current/integrated reverse current ratio being selected from the range of 1 to 100, thereby allowing a plated layer to deposit on the inner circumferential surface of the cylinder bore;

in a second step, said electrolysis is performed for a predetermined period of time with the integrated positive current/integrated reverse current ratio being selected from a range of 0.01 to 0.9, thereby allowing said plated layer to dissolve; and in a third step, said electrolysis is performed for a predetermined period of time with the integrated positive current/integrated reverse current ratio being selected from the range of 1 to 100 to thereby remove said plated layer deposited on said anode.

* * * * *